United States Patent [19]

Boggs

[11] Patent Number: 4,707,398

[45] Date of Patent: Nov. 17, 1987

[54] ELASTIC POLYETHERESTER NONWOVEN WEB

[75] Inventor: Lavada C. Boggs, Marietta, Ga.

[73] Assignee: Kimberly-Clark Corporation, Neenah, Wis.

[21] Appl. No.: 912,287

[22] Filed: Oct. 15, 1986

[51] Int. Cl.[4] ..... D03D 3/00; D04B 1/00; B04H 3/00

[52] U.S. Cl. ..... 428/224; 428/283; 428/288; 428/364; 525/437; 528/301

[58] Field of Search ..... 428/224, 283, 288, 326, 428/364, 373, 903; 525/437; 528/301

[56] References Cited

U.S. PATENT DOCUMENTS

| | | | |
|---|---|---|---|
| 2,623,031 | 12/1952 | Snyder | 260/45.4 |
| 2,903,387 | 9/1959 | Wade | 154/101 |
| 2,951,005 | 8/1960 | Hervey | 154/123 |
| 3,594,266 | 7/1971 | Okazaki | 161/173 |
| 3,642,565 | 2/1972 | Ogata et al. | 161/173 |
| 3,700,545 | 10/1972 | Matsui et al. | 161/175 |
| 3,849,241 | 11/1974 | Butin et al. | 161/169 |
| 3,971,373 | 7/1976 | Braun | 428/328 |
| 4,100,324 | 7/1978 | Anderson et al. | 428/903 |
| 4,118,531 | 10/1978 | Hauser | 428/224 |
| 4,150,674 | 4/1979 | Yung | 428/288 |
| 4,223,101 | 9/1980 | Fine et al. | 528/76 |
| 4,323,534 | 4/1982 | Des Marais | 264/179 |
| 4,375,446 | 3/1983 | Fujii et al. | 264/518 |
| 4,426,417 | 1/1984 | Meitner et al. | 428/903 |
| 4,426,420 | 1/1984 | Likhyani | 428/224 |
| 4,442,062 | 4/1984 | Fujii et al. | 264/518 |
| 4,469,734 | 9/1984 | Minto et al. | 428/134 |
| 4,623,576 | 11/1986 | Lloyd et al. | 428/903 |

FOREIGN PATENT DOCUMENTS

| | | |
|---|---|---|
| 979103 | 1/1965 | United Kingdom . |
| 575830 | 10/1980 | United Kingdom . |

OTHER PUBLICATIONS

Akzo Plastics Technical Bulletin AL 1-E, 10/84.

A. Schulman Inc. Technical Data Sheet for Arnitel, 9/4/84.

A. Schulman Inc. Technical Data Sheet for Arnitel S, 5/6/85.

*Primary Examiner*—James J. Bell

*Attorney, Agent, or Firm*—Joseph P. Harps

[57] ABSTRACT

An elastomeric nonwoven web is formed by meltblowing fibers composed of a polyetherester. Nonelastic fibers and/or particulate materials may also be included in the web.

26 Claims, 4 Drawing Figures

ELASTIC POLYETHERESTER NONWOVEN WEB

FIELD OF THE INVENTION

The present invention is generally directed to fiber formation and, in particular, to fibers which may be formed into nonwoven webs and the nonwoven webs formed therefrom.

BACKGROUND OF THE INVENTION

In the field of nonwoven materials, there has been a continuing need for materials having a high degree of flexibility and elasticity and which may be manufactured at a low cost. This need has persisted in spite of the fact that such materials could readily be utilized to manufacture a wide variety of garments of both the disposable type, such as disposable diapers, or the non-disposable type, such as pants, dresses, blouses and sporting wear, for example, sweatsuits. Further, such materials could also be utilized in, for example, upholstery, drapery, liner and insulation applications. The traits of flexibility and elasticity are particularly useful characteristics in materials for use in these areas because they permit articles manufactured from such materials to closely conform to the body of the wearer or any item, such as a fixed frame, around which the materials may be wrapped. Additionally, the need for an absorbent nonwoven elastic material has been recognized because such a material could be utilized to manufacture a great disparity of items which have improved absorbency performance as a result of the item's ability to closely conform to a body portion or to some other item which needs to be wrapped in an absorbent material. For example, such a material could be readily utilized in the areas of feminine hygiene or wound dressing.

While the above-discussed combination of characteristics has been a goal of those of skill in the field of nonwoven materials, the prior commercial materials known to us are believed to be lacking or insufficient in one or more of the above-discussed desired characteristics. For example, one group of materials which has been available to those in treating injuries are the so-called "elastic bandages", an example of which is an elastic bandage which is commercially available from the 3M Company of Minneapolis, Minn. under the trade designation "Ace Bandage". Elastic bandages of this type are generally effective in somewhat immobilizing an injured area. However, such elastic bandages generally have a poor ability to absorb bodily fluids exuding from the wound.

Another material for similar uses appears in U.K. Pat. No. 1,575,830 to Johnson and Johnson which relates to flexible and absorbent dressings including diapers, surgical dressings, first aid dressings, catamenial dressings and the like. This patent further appears to relate to dressings which include an absorbent layer laminated to a plastic backing film. The backing film is stated to be elastic and easily stretchable, as well as highly flexible. The elastic backing film may be formed from a blend of materials which contains (a) a major portion of linear or radial A-B-A block copolymers or mixtures of linear or radial A-B-A block copolymers with A-B block copolymers and (b) a resin component. It is stated that the A-blocks of the block copolymers may be derived from styrene or styrene homologs and that the B-blocks may be derived from conjugated dienes or lower alkenes and the resin component may typically include a major portion of a lower molecular weight resin adapted to associate principally with the thermoplastic A-blocks of the block copolymers. It should be noted that this patent deals with an elastic film as opposed to an elastic nonwoven web.

U.S. Pat. No. 4,426,417 to Meitner appears to disclose a matrix of nonwoven fibers which can be used as a wiper with the matrix including a meltblown web having a blend of staple fibers which is a mixture of synthetic and cotton fibers blended therein. The wipers may be formed by a meltblowing process by extruding thermoplastic polymers as filaments into an air stream which draws and attenuates the filaments into fine fibers of an average diameter of up to about ten microns. The staple fiber mixture of synthetic and cotton fibers may be added to the air stream so that the turbulence produced by the air stream results in a uniform integration of the staple fiber mixture into the meltblown web. The meltblown fiber component of the matrix may be formed from any thermoplastic composition capable of extrusion into microfibers. It is stated that examples of such compositions include polyolefins, such as polypropylene and polyethylene, polyesters, such as polyethylene terephthalate, polyamides, such as nylon, as well as copolymers and blends of these and other thermoplastic polymers. The synthetic staple fiber component of the matrix may be selected from the same thermoplastic materials with polyester being preferred. The cotton component includes staple length cotton fibers of average length generally in the range of from about one quarter inch to three quarter inch and denier from about one to one and one half. It is stated that the process for making the material includes compacting the matrix on a forming drum and then directing it over a feed roll and between a patterned roll and an anvil roll where it is pattern bonded. The particular bond pattern is preferably selected to impart favorable textile-like tactile properties while providing strength and durability.

U.S. Pat. No. 4,426,420 to Likhyani appears to disclose a spunlaced fabric which may be made by the hydraulic entanglement of hard fibers (i.e., fibers generally having low stretch characteristics) and potentially elastomeric fibers (fibers capable of elongation by at least one hundred percent before breaking and which are capable of exhibiting elastic characteristics after having been subjected to heat treatment). After hydraulic entanglement of the two types of fibers, the fabric is heat treated to develop the elastic characteristics in the elastomeric fibers. It is stated that the hard fibers may be of any synthetic fiber-forming material, such as polyesters, polyamides, acrylic polymers and copolymers, vinyl polymers, cellulose derivatives, glass, and the like, as well as any natural fiber such as cotton, wool, silk, paper and the like, or a blend of two or more hard fibers. A representative class of potentially elastic fibers is stated to include polyetheresters and more specifically, poly(butylene terephthalate)-co-poly(tetramethyleneoxy) terephthalates.

U.S. Pat. No. 4,100,324 to Anderson et al appears to disclose a nonwoven fabric-like material including an air-formed matrix of thermoplastic polymer microfibers and a multiplicity of individualized wood pulp fibers or staple fibers such as high crimped nylon fibers. It is stated that many useful thermoplastic polymers, polyolefins such as polypropylene and polyethylene, polyamides, polyesters such as polyethylene terephthalate, and thermoplastic elastomers such as polyurethanes are anticipated to find the most widespread use in the preparation of the materials of the '324 patent.

U.S. Pat. No. 3,700,545 to Matsui appears to disclose a synthetic multi-segmented fiber which includes at least ten segments composed of at least one component of fiber-forming linear polyamide and polyester extending substantially continuously along the longitudinal direction of the fiber and occupying at least a part of the periphery of the unitary multi-segmented fiber. These fibers may be produced by spinning a multi-segment spinning material having a cross-section of grainy, nebulous or archipelagic structure.

U.S. Pat. No. 3,594,266 to Okazaki appears to disclose melt spinning of a sheath/core bicomponent fiber where one component is a polyamide and the other component is a block-copolyether amide. Okazaki also discusses meltspinning of a sheath/core bicomponent fiber having a first component of a blend of polyamide and a copolyetheramide and a second component of Nylon 6. It is stated that the latter material has 34 percent elongation.

DEFINITIONS

The term "elastic" is used herein to mean any material which, upon application of a biasing force, is stretchable to a stretched, biased length which is at least about 125 percent, that is at least about one and one quarter, of its relaxed, unbiased length, and which will recover at least about 40 percent of its stretch or elongation upon release of the stretching, elongating force. A hypothetical example which would satisfy this definition of an elastic or elastomeric material would be a one (1) inch sample of a material which is elongatable to at least 1.25 inches and which, upon being elongated to 1.25 inches and released, will return to a length of not more than 1.15 inches. Many elastic materials may be stretched by much more than 25 percent of their relaxed length, for example 100 percent, or more, and many of these will return to substantially their original relaxed length, for example, to within 105 percent of their original relaxed length upon release of the stretching, elongating force.

As used herein the term "nonelastic" is intended to include any material not encompassed by the above definition of the term "elastic".

As used herein the term "microfibers" means small diameter fibers having an average diameter not greater than about 100 microns, preferably having a diameter of from about 0.5 microns to about 50 microns, more preferably having an average diameter of from about 4 microns to about 40 microns.

As used herein the term "meltblown fibers" means fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameter. Thereafter, the meltblown fibers are carried by the high velocity gas stream and are deposited on a collecting surface to form a web of randomly disbursed meltblown microfibers. Such a process is disclosed, for example, in U.S. Pat. No. 3,849,241 to Buntin and the disclosure of this patent is hereby incorporated by reference.

As used herein the term "nonwoven" includes any web of material which has been formed without the use of a weaving. process which produces a structure of individual fibers which are interwoven in an identifiable repeating manner. Specific examples of nonwoven webs would include, without limitation, a meltblown nonwoven web, a spunbonded nonwoven web and a carded web. Nonwoven webs generally have an average basis weight of from about 5 grams per square meter to about 300 grams per square meter. More particularly, the nonwoven webs of the present invention may have an average basis weight of from about 10 grams per square meter to about 120 grams per square meter.

As used herein the term "polyetherester" refers to any material having the general formula of:

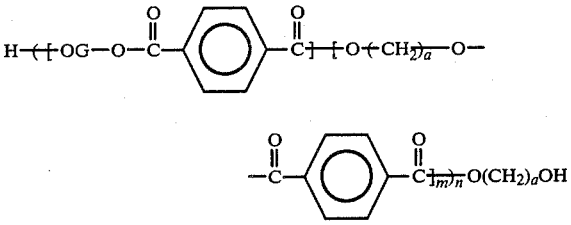

where

"G" is selected from the group including poly(oxyethylene)-alpha,omega-diol poly(oxypropylene)-alpha,omega-diol or poly(oxytetramethylene)-alpha,omega-diol and "m", "n" and "a" are positive integers. For example, "a" may be 2, 4 or 6.

As used herein the term "absorbent fiber" means any fiber which is capable of absorbing at least 100 percent of its weight of a fluid.

As used herein the term "superabsorbent fiber" means any fiber which is capable of absorbing at least 400 percent of its weight of a fluid.

Unless herein specifically set forth and defined or otherwise limited, the term polymer generally includes, but is not limited to, homopolymers, copolymers, such as, for example, block, graft, random and alternating copolymers, terpolymers, etc. and blends and modifications thereof. Furthermore, unless otherwise specifically limited, the term polymer shall include all possible geometrical configurations of the material. These configurations include, but are not limited to, isotactic, syndiotactic and random symmetries and, for example, linear and radial polymers.

As used herein the term "consisting essentially of" does not exclude the presence of additional materials which do not significantly affect the properties of a given material. Exemplary additional materials of this sort would include, without limitation, pigments, antioxidants, stabilizers, waxes, flow promoters, solvents, plasticizers, particulates and materials added to enhance the processability of the material.

OBJECTS OF THE INVENTION

Accordingly, it is a general object of the present invention to provide elastic fibers formed from a polyetherester.

Another general object of the present invention is to provide an elastic nonwoven web which is composed of a coherent nonwoven matrix of elastic fibers formed from a polyetherester.

Yet another general object of the present invention is to provide an elastic nonwoven web which is composed of a coherent nonwoven matrix of elastic fibers formed from a polyetherester with at least one other type of fiber being distributed within or on the matrix.

A further object of the present invention is to provide an elastic absorbent nonwoven web which is composed of a coherent nonwoven matrix of elastic fibers formed from a polyetherester with at least one type of absorbent fiber being distributed within or on the matrix.

Still further objects and the broad scope of applicability of the present invention will become apparent to those of skill in the art from the details given hereinafter. However, it should be understood that the detailed description of the presently preferred embodiment given herein of the present invention is given only by way of illustration because various changes and modifications well within the spirit and scope of the invention will become apparent to those of skill in the art in view of this detailed description.

SUMMARY OF THE INVENTION

The present invention provides elastic meltblown fibers formed from a polyetherester. The elastic meltblown fibers may be formed into an elastic nonwoven web which includes a coherent nonwoven matrix of fibers which, for example, may be microfibers. The elastic nonwoven web may also include at least one type of secondary fibers, for example secondary microfibers, which are distributed within or upon the matrix. The secondary fibers may be generally uniformly distributed throughout the matrix.

The elastic fibers are formed from a polyetherester material having the formula:

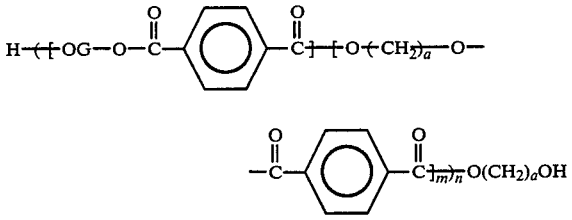

where

"G" is selected from the group including: poly(oxyethylene)-alpha,omega-diol poly(oxypropylene)-alpha,omega-diol poly(oxytetramethylene)-alpha,omega-diol and "a", "m" and "n" are positive integers. For example, "a" may be 2, 4 or 6.

In particular, the polyetherester has a density of from about 1.10 to about 1.18 when measured in accordance with ASTM D-792; a melt point of from about 350° F. to about 400° F. when measured in accordance with ASTM D-2117; a tensile strength of from about 2,250 psi to about 3,250 psi when measured in accordance with ASTM D-638; an elongation at break of from about 600 percent to about 750 percent when measured in accordance with ASTM D-638; a flexural modulus of from about 6,500 psi to about 15,000 psi when measured in accordance with ASTM D-790 and a moisture absorption (at equilibrium, room temperature and 50 percent relative humidity) of from about 0.28 percent to 0.34 percent.

More particularly, the polyetherester has a density of about 1.12 when measured in accordance with ASTM D-792; a melt point of about 383° F. when measured in accordance with ASTM D-2117; a tensile strength of about 2,468 psi when measured in accordance with ASTM D-638, an elongation at break of about 650 percent when measured in accordance with ASTM D-638 and a flexural modulus of about 7,258 psi when measured in accordance with ASTM D-790.

The secondary fibers, which may be microfibers, may be selected from the group including polyester fibers, polyamide fibers, glass fibers, polyolefin fibers, cellulosic derived fibers, multi-component fibers, natural fibers or electrically conductive fibers or blends of two or more of said secondary fibers. If the secondary fibers are natural fibers, the natural fibers may be selected from the group including cotton fibers, wool fibers and silk fibers. If the secondary fibers are polyolefin fibers, the polyolefin fibers may be selected from the group including polyethylene fibers or polypropylene fibers. If the secondary fibers are cellulosic derived fibers, the cellulosic derived fibers may be selected from the group including rayon fibers or wood fibers, for example, wood pulp If the secondary fibers are polyamide fibers, the polyamide fibers may be nylon fibers. If the secondary fibers are multi-component fibers, the multi-component fibers may be sheath-core fibers or side-by-side fibers. The secondary fibers may be absorbent or superabsorbent fibers.

If secondary fibers are present in the nonwoven elastic web, the nonwoven elastic web may generally include from about 20 percent, by weight, to about 99 percent, by weight, of fibers formed from the polyetherester material blended with from about 1 percent, by weight to 80 percent, by weight, of the secondary fibers. For example, the elastic nonwoven web may include from about 50 percent, by weight to about 99 percent, by weight, of fibers formed from the polyetherester blended with from about 1 percent, by weight, to about 50 percent, by weight, of the secondary fibers. More particularly, the elastic nonwoven web may include from about 75 percent, by weight, to about 95 percent, by weight, of fibers formed from the polyetherester blended with from about 5 percent, by weight, to about 25 percent, by weight, of the secondary fibers. In certain applications, particulate materials may be substituted for the secondary fibers or the elastic nonwoven web may have both secondary fibers and particulate materials incorporated into the matrix of coherent polyetherester fibers. In such a three component system, the elastic nonwoven web may contain from about 50 percent, by weight, to about 98 percent, by weight, of the polyetherester fibers, from about 1 percent, by weight, to about 49 percent, by weight, of secondary fibers and from about 1 percent, by weight, to about 49 percent, by weight, of particulate materials. Exemplary particulate materials are activated charcoal and powdered superabsorbent.

DETAILED DESCRIPTION OF THE INVENTION

Figure 1:
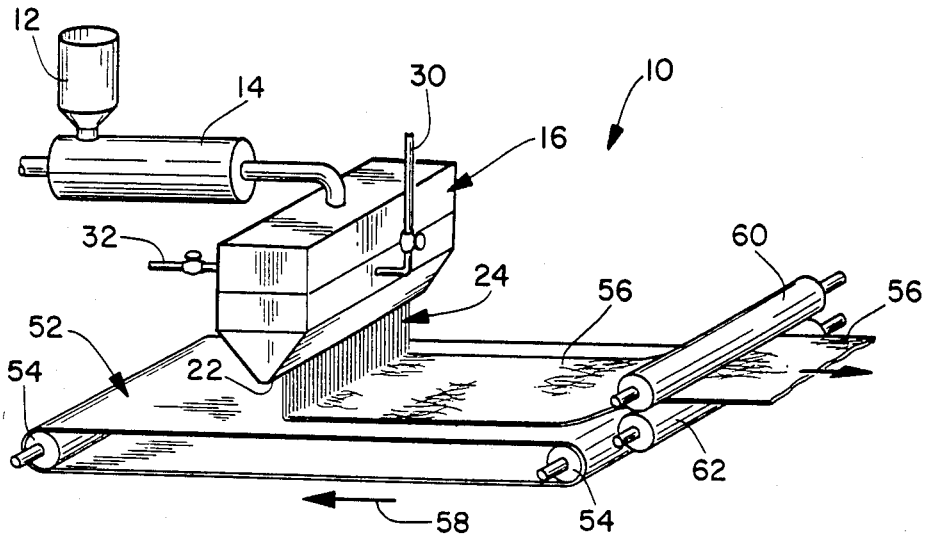
FIG. 1 is a schematic illustration of an apparatus which may be utilized to form the elastic nonwoven web of the present invention.

Turning now to the figures wherein like reference numerals represent the same or equivalent structure and, in particular, to FIG. 1 where it can be seen that an apparatus for forming the elastic nonwoven web of the present invention is schematically generally represented by reference numeral 10. In forming the elastic nonwoven web of the present invention pellets or chips, etc.(-not shown) of a polyetherester material are introduced into a pellet hopper 12 of an extruder 14.

One polyetherester may be obtained under the trade deshgnation Arnitel, for example, Arnitel EM-400, from A. Schulman, Inc. of Akron, Ohio or Akzo Plastics of Arnhem, Holland.

Schulman literature indicates that at least two grades of Arnitel are are available under the trade designations EM 400 and EM 460. This literature also reports certain properties of these materials which are summarized below in Table I.

TABLE I

| PROPERTY | EM-400 | EM-460 | MEASURED BY ASTM STANDARD |
|---|---|---|---|
| Density | 1.12 | 1.16 | D-792 |
| Melt Point | | | |
| (deg. F.) | 383 | 365 | D-2117 |
| (deg. C.) | 195 | 185 | |
| Water absorption at equilibrium at RT and 50% RH (%) | 0.32 | 0.30 | D-570 |
| Tensile strength (psi) | 2,468 | 3,048 | D-638 |
| Elongation at break (%) | 650 | 700 | D-638 |
| Flexural Modulus (psi) | 7,258 | 14,516 | D-790 |

From the table, above, it can be seen that these Arnitel polyetherester materials have a density of from about 1.10 to about 1.18 when measured in accordance with ASTM D-792; a melt point of from about 350° F. to about 400° F. when measured in accordance with ASTM D-2117; a water absorption at equilibrium, room temperature and 50 percent relative humidity of from about 0.28 percent to about 0.34 percent; a tensile strength of from about 2,250 psi to about 3,250 psi when measured in accordance with ASTM D-638; an elongation at break of from about 600 percent to about 750 percent when measured in accordance with ASTM D-638 and a flexural modulus of from about 6,500 psi to about 15,000 psi when measured in accordance with ASTM . D-790.

More particularly, the Arnitel EM-400 polyetherester has a density of about 1.12 when measured in accordance with ASTM D-792; a melt point of about 383° F. when measured in accordance with ASTM D-2117; a water absorption of about 0.32 percent at equilibrium, room temperature and 50 percent relative humidity; a tensile strength of about 2,468 psi when measured in accordance with ASTM D-638, an elongation at break of about 650 percent when measured in accordance with ASTM D-638 and a flexural modulus of about 7,258 psi when measured in accordance with ASTM D-790.

The polyetherester may be mixed with other appropriate materials, such as, for example, pigments, antioxidants, stabilizers, waxes, flow promoters, solid solvents, particulates and processing enhancing additives, prior to or after its introduction into the hopper 12.

The extruder 14 has an extrusion screw (not shown) which is driven by a conventional drive motor (not shown). As the polyetherester advances through the extruder 14, due to rotation of the extrusion screw by the drive motor, it is progressively heated to a molten state. Heating of the polyetherester to the molten state may be accomplished in a plurality of discrete steps with its temperature being gradually elevated as it advances through discrete heating zones of the extruder 14 toward a meltblowing die 16. The die 16 may be yet another heating zone where the temperature of the thermoplastic resin is maintained at an elevated level for extrusion. The temperature which will be required to heat the polyetherester to a molten state will vary somewhat depending upon which grade of polyetherester is utilized and can be readily determined by those in the art. However, generally speaking, the Arnitel polyetherester may be extruded within the temperature range of from about 176 degrees Centigrade to about 300 degrees Centigrade. For example, the extrusion may be accomplished within a temperature range of from about 185 degrees. Centigrade to about 282 degrees Centigrade. Heating of the various zones of the extruder 14 and the meltblowing die 16 may be achieved by any of a variety of conventional heating arrangements (not shown).

Figure 2:
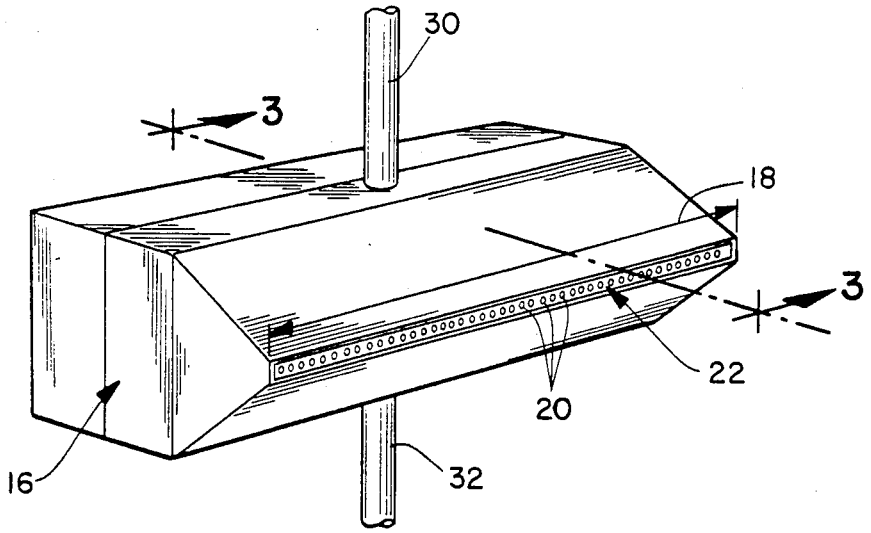
FIG. 2 is a bottom view of the die of FIG. 1 with the die having been rotated 90 degrees for clarity.

FIG. 2 illustrates that the lateral extent 18 of the die 16 is provided with a plurality of orifices 20 which are usually circular in cross-section and are linearly arranged along the extent 18 of the tip 22 of the die 16. The orifices 20 of the die 16 may have diameters that range from about 0.01 of an inch to about 0.02 of an inch and a length which may range from about 0.05 inches to about 0.20 inches. For example, the orifices may have a diameter of about 0.0145 inches and a length of about 0.113 inches. From about 5 to about 50 orifices may be provided per inch of the lateral extent 18 of the tip 22 of the die 16 with the die 16 extending from about 30 inches to about 60 inches or more. FIG. 1 illustrates that the molten polyetherester emerges from the orifices 20 of the die 16 as molten strands or threads 24.

Figure 3:
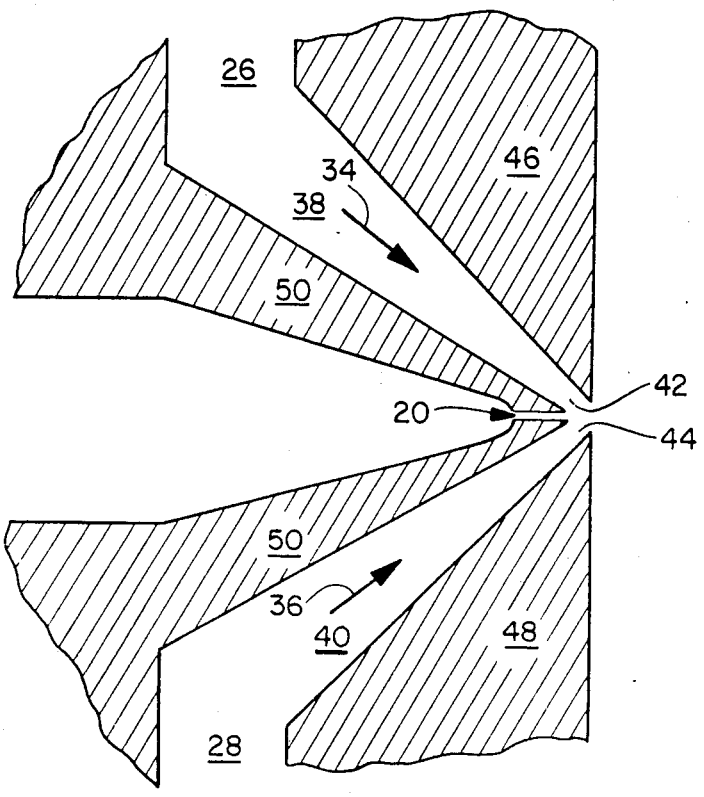
FIG. 3 is a cross-sectional view of the die of FIG. 1 taken along line 3—3 of FIG. 2.

FIG. 3, which is a cross-sectional view of the die of FIG. 2 taken along line 3—3, illustrates that the die 16 preferably includes attenuating gas inlets 26 and 28 which are provided with heated, pressurized attenuating gas (not shown) by attenuating gas sources 30 and 32. (See FIGS. 1 and 2.) The heated, pressurized attenuating gas enters the die 16 at the inlets 26 and 28 and follows a path generally designated by the arrows 34 and 36 through the two chambers 38 and 40 and on through the two narrow passageways or gaps 42 and 44 so as to contact the extruded threads 24 as they exit the orifices 20 of the die 16. The chambers 38 and 40 are designed so that the heated attenuating gas passes through the chambers 38 and 40 and exits the gaps 42 and 44 to form a stream (not shown) of attenuating gas which exits the die 16 on both sides of the threads 24. The temperature and pressure of the heated stream of attenuating gas can vary widely. For example, the heated attenuating gas can be applied at a temperature of from about 245 degrees Centigrade to about 304 degrees Centigrade, more particularly, from about 260 degrees Centigrade to about 300 degrees Centigrade. The heated attenuating gas may generally be applied at a pressure of from about 0.5 pounds per square inch, gage to about 20 pounds per square inch, gage. More particularly, from about 1 pound per square inch, gage to about 5 pounds per square inch, gage.

The position of air plates 46 and 48 which, in conjunction with a die portion 50 define the chambers 38 and 40 and the gaps 42 and 44, may be adjusted relative to the die portion 50 to increase or decrease the width of the attenuating gas passageways 42 and 44 so that the volume of attenuating gas passing through the air passageways 42 and 44 during a given time period can be varied without varying the velocity of the attenuating gas. Furthermore, the air plates 46 and 48 may be adjusted to effect a "recessed" die-tip configuration as illustrated in FIG. 3 or a positive die-tip 22 stick-out where the tip of die portion 50 protrudes beyond the plane formed by the plates 48. Generally speaking, a positive die-tip stick-out configuration and attenuating gas pressures of less than 5 pounds per square inch, gage are used in conjunction with air passageway widths, which are usually the same and are no greater in width than about 0.110 inches. Lower attenuating gas velocities and wider air passageway gaps are generally preferred if substantially continuous meltblown fibers or microfibers 24 are to be produced.

The two streams of attenuating gas converge to form a stream of gas which entrains and attenuates the molten threads 24, as they exit the orifices 20, into fibers or, depending upon the degree of attenuation, microfibers, cf a small diameter which is usually less than the diameter of the orifices 20. The gas-borne fibers or microfibers 24 are blown, by the action of the attenuating gas, onto a collecting arrangement which, in the embodiment illustrated in FIG. 1, is a foraminous endless belt 52 conventionally driven by rollers 54. Other foraminous arrangements such as a rotating drum could be utilized. One or more vacuum boxes (not illustrated) may be located below the surface of the foraminous belt 52 and between the rollers 54. The fibers or microfibers 24 are collected as a coherent matrix of fibers on the surface of the endless belt 52 which is rotating as indicated by the arrow 58 in FIG. 1. The vacuum boxes assist in retention of the matrix on the surface of the belt 52. Typically the tip 22 of the die 16 is from about 6 inches to about 14 inches from the surface of the foraminous belt 52 upon which the fibers are collected. The thus-collected, entangled fibers or microfibers 24 are coherent and may be removed from the belt 52 as a self-supporting nonwoven web 56 by a pair of pinch rollers 60 and 62 which may be designed to press the fibers of the web 56 together to improve the integrity of the web 56.

Figure 4:
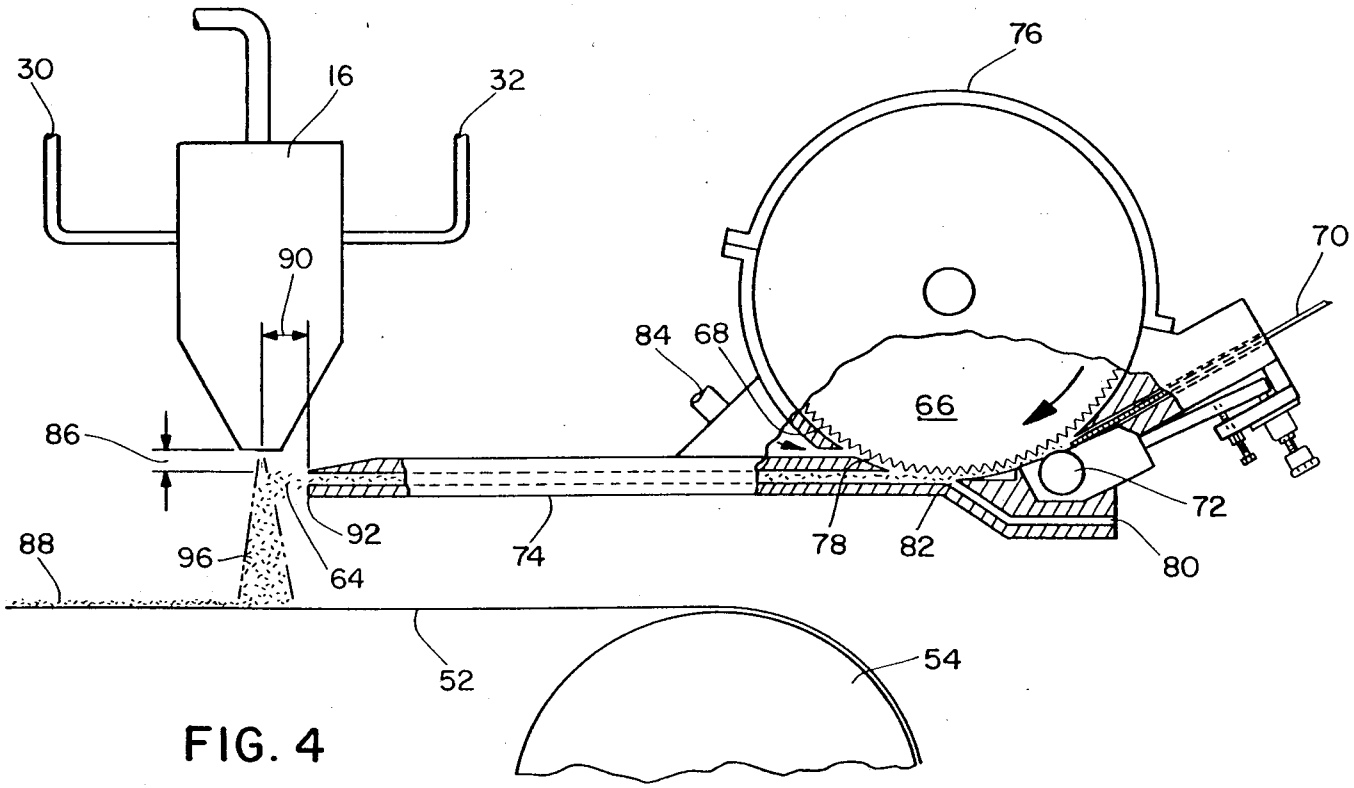
FIG. 4 is a schematic illustration of an apparatus which may be utilized to form the embodiment of the present invention where secondary fibers are incorporated into the matrix of coherent polyetherester fibers.

FIG. 4 illustrates another embodiment of the present invention where one or more types of secondary fibers 64 are distributed within or upon the stream of thermoplastic fibers or microfibers 24. Distribution of the secondary fibers 64 within the stream of fibers 24 may be such that the secondary fibers 64 are generally uniformly distributed throughout the stream of polyetherester fibers 24. This may be accomplished by merging a secondary gas stream (not shown) containing the secondary fibers 64 with the stream of fibers 24. Apparatus for accomplishing this merger may include a conventional picker roll 66 arrangement which has a plurality of teeth 68 that are adapted to separate a mat or batt 70 of secondary fibers into the individual secondary fibers 64. The mat or batt of secondary fibers 70 which is fed to the picker roll 66 may be a sheet of pulp fibers (if a two component mixture of polyetherester fibers and secondary pulp fibers is desired), a mat of. staple fibers (if a two component mixture of polyetherester fibers and secondary staple fibers is desired) or both a sheet of pulp fibers and a mat of staple fibers (if a three component mixture of polyetherester fibers, secondary staple fibers and secondary pulp fibers is desired). In embodiments where, for example, an absorbent material is desired, the secondary fibers 64 are absorbent fibers. The secondary fibers 64 may generally be selected from the group including one or more polyester fibers, polyamide fibers, polyolefin fibers such as, for example, polyethylene fibers and polypropylene fibers, cellulosic derived fibers such as, for example, rayon fibers and wood pulp fibers, multi-component fibers such as, for example, sheath-core multi-component fibers or side-by-side multi-component fibers, natural fibers such as silk fibers, wool fibers or cotton fibers or electrically conductive fibers or blends of two or more of such secondary fibers. Other types of secondary fibers 64 as well as blends of two or more of other types of secondary fibers 64 may be utilized. The secondary fibers 64 may be microfibers or the secondary fibers 64 may be macrofibers having an average diameter of from about 300 microns to about 1,000 microns.

The sheets or mats 70 of secondary fibers 64 are fed to the picker roll 66 by a roller arrangement 72. After the teeth 68 of the picker roll 66 have separated the mat of secondary fibers 70 into separate secondary fibers 64 the individual secondary fibers 64 are conveyed toward the stream of polyetherester fibers or microfibers 24 through a nozzle 74. A housing 76 encloses the picker roll 66 and provides a passageway or gap 78 between the housing 76 and the surface of the teeth 68 of the picker roll 66. A gas (not shown), for example air, is supplied to the passageway or gap 78 between the surface of the picker roll 66 and the housing 76 by way of a gas duct 80. The gas duct 80 may enter the passageway or gap 78 generally at the junction 82 of the nozzle 74 and the gap 78. The gas is supplied in sufficient quantity to serve as a medium for conveying the secondary fibers 64 through the nozzle 74. The gas supplied from the duct 80 also serves as an aid in removing the secondary fibers 64 from the teeth 68 of the picker roll 66. However, gas supplied through the duct 84 generally provides for the removal of the secondary fibers 64 from the teeth of the picker roll 66. The gas may be supplied by any conventional arrangement such as, for example, an air blower (not shown).

Generally speaking, the individual secondary fibers 64 are conveyed through the nozzle 74 at generally the velocity at which the secondary fibers 64 leave the teeth 68 of the picker roll 66. In other words, the secondary fibers 64, upon leaving the teeth 68 of the picker roll 66 and entering the nozzle 74, generally maintain their velocity in both magnitude and direction from the point where they left the teeth 68 of the picker roll 66. Such an arrangement, which is discussed in more detail in U.S. Pat. No. 4,100,324 to Anderson et al., hereby incorporated by reference, aids in substantially reducing fiber floccing.

As an aid in maintaining satisfactory secondary fiber 64 velocity, the nozzle 74 may be positioned so that its longitudinal axis is substantially parallel to a plane which is tangent to the picker roll 66 at the junction 82 of the nozzle 74 with the passageway 78. As a result of this configuration, the velocity of the secondary fibers 64 is not substantially changed by contact of the secondary fibers 64 with the walls of the nozzle 74. If the secondary fibers 64 temporarily remain in contact with the teeth 68 of the picker roll 66 after they have been separated from the mat or batt 70, the axis of the nozzle 74 may be adjusted appropriately to be aligned with the direction of secondary fiber 64 velocity at the point where the secondary fibers 64 disengage from the teeth 68 of the picker roll 66. The disengagement of the secondary fibers 64 from the teeth 68 of the picker roll 66 may be assisted by application of a pressurized gas, i.e., air through duct 84.

The vertical distance 86 that the nozzle 74 is below the die tip 22 may be adjusted to vary the properties of the composite web 88. Variation of the horizontal distance 90 of the tip 92 of the nozzle 74 from the die tip 24 will also achieve variations in the final elastic nonwoven web 88. The vertical distance 86 and the horizontal distance 90 values will also vary with the material being added to the polyetherester fibers 24. The width of the nozzle 74 along the picker roll 66 and the length that the nozzle 74 extends from the picker roll 66 are also important in obtaining optimum distribution of the secondary fibers 64 throughout the stream of fibers 24. It is usually desirable for the length of the nozzle 74 to be as short as equipment design will allow. The length is usually limited to a minimum length which is generally equal to the radius of the picker roll 66. Usually, the width of the nozzle 74 should not exceed the width of the sheets or mats 70 that are being fed to the picker roll 66.

The picker roll 66 may be replaced by a conventional particulate injection system to form a composite nonwoven web 88 containing various secondary particulates. A combination of both secondary particulates and secondary fibers could be added to the polyetherester fibers prior to formation of the composite nonwoven web 88 if a conventional particulate injection system was added to the system illustrated in FIG. 4.

FIG. 4 further illustrates that the gas stream carrying the secondary fibers 64 is moving in a direction which is generally perpendicular to the direction of movement of the stream of polyetherester fibers 24 at the point of merger of the two streams. Other angles of merger of the two streams may be utilized. The velocity of the gas stream of secondary fibers 64 is usually adjusted so that it is less than the velocity of the stream of polyetherester fibers 24. This allows the streams, upon merger and integration thereof to flow in substantially the same direction as that of the stream of polyetherester fibers 24. Indeed, the merger of the two streams may be accomplished in a manner which is somewhat like an aspirating effect where the stream of secondary fibers 64 is drawn into the stream of polyetherester fibers 24. If desired the velocity difference between the two gas streams may be such that the secondary fibers 64 are integrated into the polyetherester fibers 24 in a turbulent manner so that the secondary fibers 64 become substantially thoroughly and uniformly mixed throughout the polyetherester fibers 24. Generally, for increased production rates the gas stream which entrains and attenuates the stream of polyetherester fibers 24 should have a comparatively high initial velocity, for example from about 200 feet to over 1,000 feet per second, and the stream of gas which carries the secondary fibers 64 should have a comparatively low initial velocity, for example from about 50 to about 200 feet per second. After the stream of gas that entrains and attenuates the polyetherester fibers 24 exits the gaps 42 and 44 of the die 16, it immediately expands and decreases in velocity.

Upon merger and integration of the stream of secondary fibers 64 into the stream of polyetherester fibers 24 to generally uniformly distribute the secondary fibers 64 throughout the stream of polyetherester fibers 24, a composite stream 96 of thermoplastic fibers 24 and secondary fibers 64 is formed. Due to the fact that the polyetherester fibers 24 are usually still semi-molten and tacky at the time of incorporation of the secondary fibers 64 into the polyetherester fibers 24, the secondary fibers 64 are usually not only mechanically entangled within the matrix formed by the polyetherester fibers 24 but are also thermally bonded or joined to the polyetherester fibers 24.

In order to convert the composite stream 96 of polyetherester fibers 24 and secondary fibers 64 into a composite elastic nonwoven web or mat 88 composed of a coherent matrix of the polyetherester fibers 24 having the secondary fibers 64 generally uniformly distributed therein, a collecting device is located in the path of the composite stream 96. The collecting device may be the endless belt 52 of FIG. 1 upon which the composite stream 96 impacts to form the composite nonwoven web 56. The belt 52 is usually porous and a conventional vacuum arrangement (not shown) which assists in retaining the composite stream 96 on the external surface of the belt 52 is usually present. Other collecting devices are well known to those of skill in the art and may be utilized in place of the endless belt 52. For example, a porous rotating drum arrangement could be utilized. Thereafter, the composite elastic nonwoven web 88 is removed from the screen by the action of rollers such as roller 60 and 62 shown in FIG. 1.

EXAMPLE I

A fibrous nonwoven elastic web was formed by meltblowing a polyetherester obtained from Akzo Plastics under the trade designation Arnitel EM 400.

Meltblowing of the Arnitel EM 400 was accomplished by extruding the thermoplastic elastomer through a 1½ inch diameter Johnson extruder and through a meltblowing die having 30 extrusion capillaries per lineal inch of die tip. The capillaries each had a diameter of about 0.0145 inches and a length of about 0.113 inches. The Arnitel EM 400 was extruded through the capillaries at a rate of about 0.1513 grams per capillary per minute at a temperature of about 272 degrees Centigrade. The extrusion pressure exerted upon the Arnitel EM 400 in the die tip was measured as 196 pounds per square inch, gage. The die tip configuration was adjusted so that it had a positive die tip stickout of about 0.010 inches from the plane of the external surface of the lips of the air plates which form the air passageways on either side of the capillaries. The air plates were adjusted so that the two air passageways, one on each side of the extrusion capillaries, formed air passageways of a width or gap of about 0.067 inches. Forming air for meltblowing the Arnitel EM 400 was supplied to the air passageways at a temperature of about 284 degrees Centigrade and at a pressure of about 3 pounds per square inch, gage. The viscosity of the Arnitel EM 400 was calculated at 653 poise in the capillaries. The meltblown fibers thus formed were blown onto a forming screen which was approximately 14 inches from the die tip.

Examples 2–7 were conducted in the fashion stated with regard to Example 1. All of the examples were performed with Arnitel EM 400 on a 1½ inch diameter Johnson extruder and with a meltblowing die which had 30 extrusion capillaries per lineal inch of die tip. The capillaries of the meltblowing die each had a diameter of about 0.0145 inches and a length of about 0.113 inches. The various process parameters of Examples 2–7 are detailed in Table II.

TABLE II

| Example | 2 | 3 | 4 | 5 | 6 | 7 |
|---|---|---|---|---|---|---|
| Extrusion Rate[1] | 0.1513 | 0.1513 | 0.1513 | 0.1513 | 0.2522 | 0.2522 |
| Extrusion Die Temperature[2] | 272 | 272 | 272 | 272 | 282 | 283 |
| Extrusion Die Pressure[3] | 183 | 180 | 170 | 187 | 200 | 196 |
| Die Tip Stick-Out[4] | 0.010 | 0.010 | 0.010 | 0.010 | 0.010 | 0.010 |
| Air Passageway Gap[5] | 0.067 | 0.067 | 0.067 | 0.067 | 0.067 | 0.067 |
| Air Temperature[6] | 284 | 284 | 284 | 284 | 296 | 296 |
| Air Pressure[7] | 3 | 1 | 1 | 1 | 3 | 3 |
| Material Viscosity[8] | 610 | 605 | 567 | 623 | 400 | 392 |
| Distance[9] Die-Tip to Forming Screen | 14 | 14 | 14 | 14 | 14 | 14 |

The following footnotes apply to Table II:
[1]in grams per capillary per minute
[2]in degrees Centigrade
[3]in pounds per square inch, gage in the capillaries
[4]negative values indicate recessed die tip arrangement, in inches
[5]in inches
[6]in degrees Centigrade
[7]in pounds per square inch, gage
[8]in poise
[9]in inches

TENSILE AND CYCLING DATA

EXAMPLES 1–7

The resulting meltblown fabrics were tested on an Instron tensile tester. Samples are cut to 3" width by 7" length, with the 7" dimension in the direction of stretch measurement. Five samples are cut for each fabric direction measured (machine direction and cross machine direction). The sample is placed lengthwise in jaw faces, 3" wide×1" length, with a jaw span or separation of 4 inches. The Instron crosshead speed is set at 20 inches per minute. The peak and break elongation and the peak load were recorded and are presented in Table III.

The extension and load values may be varied over a wide range as needed by varying the process conditions accordingly. (See Examples 1–7.) The values reported in Table III are average values for five replicate tests. The figure in parenthesis represents the coefficient of variation of the five test values from the average value reported.

Stress-relaxation cycling tests for samples 1 and 4 were conducted. These tests require that the sample of elastomeric fabric be cycled from 0% to X% elongation and then returned to a relaxed state. X% elongation is 75% of the peak elongation as determined from the tensile data. After the fifth extension, the fabric is elongated one final time to break. Examples 1 and 4 reveal that the elastic fabric achieves about the same peak load on successive stretches to the same predetermined elongation.

TABLE III*

| | Basis | Peak Elongation (%) | | Peak Load (LB) | | Break Elongation (%) | | Cycle | Cycle Elong (%) | | Cycle Peak Load (LB) | |
|---|---|---|---|---|---|---|---|---|---|---|---|---|
| Ex | Wt. (gsm) | MD | CD | MD | CD | MD | CD | No. | MD | CD | MD | CD |
| 1 | 63.1 | 71(.12) | 388(.14) | 4.51(.07) | 6.24(.16) | 126(.20) | 405(.14) | 1 | 55 | 300 | 5.06(.07) | 5.89(.09) |
| | | | | | | | | 2 | 55 | 300 | 4.74(.07) | 5.46(.09) |
| | | | | | | | | 3 | 55 | 300 | 4.56(.07) | 5.24(.09) |
| | | | | | | | | 4 | 55 | 300 | 4.45(.07) | 5.08(.10) |
| | | | | | | | | 5 | 55 | 300 | 4.37(.07) | 4.97(.10) |
| 2 | 116.7 | 69(.12) | 515(.03) | 5.78(.07) | 11.40(.04) | 137(.35) | 532(.03) | | | | | |
| 3 | 46.5 | 277(.10) | 630(.06) | 2.91(.08) | 3.42(.08) | 369(.10) | Did Not Break** | | | | | |
| 4 | 86.3 | 316(.09) | 601(.00) | 6.70(.04) | 5.90(.02) | 359(.10) | Did Not Break** | 1 | 225 | 450 | 5.93(.03) | 4.73(.03) |
| | | | | | | | | 2 | 225 | 450 | 5.67(.03) | 4.48(.03) |
| | | | | | | | | 3 | 225 | 450 | 5.49(.03) | 4.32(.03) |
| | | | | | | | | 4 | 225 | 450 | 5.37(.04) | 4.21(.03) |
| | | | | | | | | 5 | 225 | 450 | 5.28(.04) | 4.14(.03) |
| 5 | 109.3 | 328(.05) | 611(.08) | 7.50(.06) | 7.62(.06) | 326(.05) | Did Not Break** | | | | | |
| 6 | 56.6 | 592(.04) | 602(.03) | 6.38(.11) | 4.96(.02) | 569(.00) | 600(.00) | | | | | |
| 7 | 100.4 | 555(.07) | 600(.00) | 9.51(.17) | 8.62(.03) | 572(.00) | Did Not Break** | | | | | |

*Data Not Normalized
**Sample did not break at the maximum extension capability of the machine. (About 600%)

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. Elastic meltblown microfibers comprising:

a polyetherester material having the general formula of:

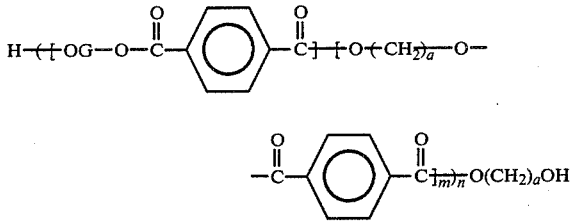

where

"G" is selected from the group consisting of: poly-(oxyethylene)-alpha,omega-diol poly(oxy-propylene)-alpha,omega-diol poly(oxytetrame-thylene)-alpha,omega-diol and "a", "m" and "n" are positive integers; and wherein said material has an elongation at break of from about 600 percent to 750 percent when measured in accordance with ASTM D-638 and a melt point of from about 350° F. to about 400° F. when measured in accordance with ASTM D-2117.

2. The elastic meltblown fibers of claim 1 wherein "a" is selected from the group consisting of 2, 4 or 6.

3. The elastic meltblown fiber of claim 1 wherein said fibers are microfibers.

4. The elastic meltblown microfibers of claim 1, wherein said material has a density of from about 1.10 to about 1.18 when measured in accordance with ASTM D-792.

5. Elastic meltblown microfibers consisting essentially of:

a polyetherester material having the general formula

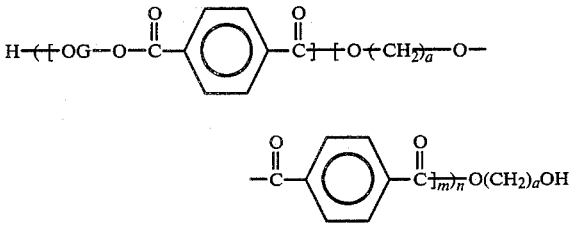

where:

"G" is selected from the group consisting of: poly-(oxyethylene)-alpha,omega-diol poly(oxy-propylene)-alpha,omega-diol poly(oxytetrame-thylene)-alpha,omega-diol and "a", "m" and "n" are positive integers; and wherein said material has an elongation at break of from about 600 percent to 750 percent when measured in accordance with ASTM D-638 and a melt point of from about 350° F. to about 400° F. when measured in accordance with ASTM D-2117.

6. An elastic nonwoven web comprising:

a coherent matrix of fibers formed from a polyetherester material having the general formula of:

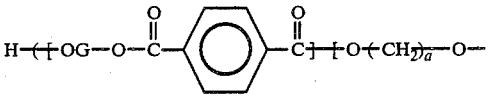

-continued

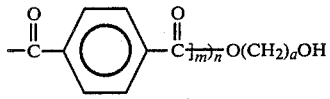

where:

"G" is selected from the group consisting of: poly-(oxyethylene)-alpha,omega-diol poly(oxy-propylene)-alpha,omega-diol poly(oxytetrame-thylene)-alpha,omega-diol and "a", "m" and "n" are positive integers; and wherein said material has an elongation at break of from about 600 percent to 750percent when measured in accordance with ASTM D-638 and a melt point of from about 350° F. to about 400° F. when measured in accordance with ASTM D-2117.

7. The elastic nonwoven web of claim 6, wherein "a" is selected from the group consisting of 2, 4 or 6.

8. The elastic nonwoven web of claim 6, wherein said fibers are microfibers.

9. The elastic nonwoven web of claim 6, wherein said material has a density of from about 1.10 to about 1.18 when measured in accordance with ASTM D-792.

10. An elastic nonwoven web consisting essentially of:

a coherent matrix of fibers formed from a polyetherester material having the general formula of:

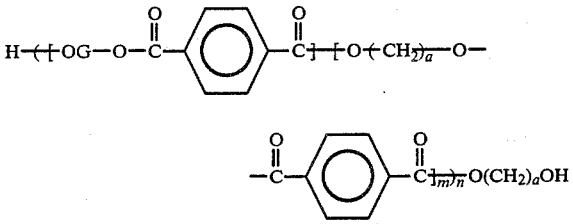

where:

"G" selected from the group consisting of: poly-(oxyethylene)-alpha,omega-diol poly(oxy-propylene)-alpha,omega-diol poly(oxytetrame-thylene)-alpha,omega-diol and "a", "m" and "n" are positive integers; and wherein said material has an elongation at break of from about 600 percent to 750 percent when measured in accordance with ASTM D-638 and a melt point of from about 350° F. to about 400° F. when measured in accordance with ASTM D-2117.

11. An elastic nonwoven web comprising:

a coherent matrix of fibers formed from a polyetherester material having the general formula of:

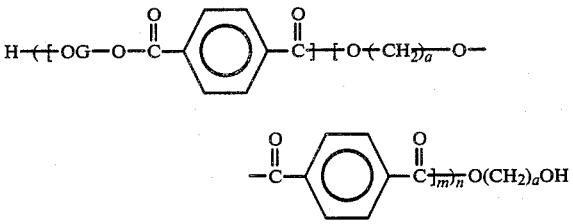

where:

"G" is selected from the group consisting of: poly-(oxyethylene)-alpha,omega-diol poly(oxypropylene)-alpha,omega-diol poly(oxytetramethylene)-alpha,omega-diol and "a", "m" and "n" are positive integers; and wherein said material has an elongation at break of from about 600 percent to 750 percent when measured in accordance with ASTM D-638 and a melt point of from about 350° F. to about 400° F. when measured in accordance with ASTM D-2117; and nonelastic secondary fibers.

12. The elastic nonwoven web of claim 11, wherein "a" is selected from the group consisting of 2, 4 or 6.

13. The elastic nonwoven web of claim 11, wherein said fibers are microfibers.

14. The elastic nonwoven web of claim 11, wherein said material has a density of from about 1.10 to about 1.18 when measured in accordance with ASTM D-792.

15. The elastic nonwoven web of claim 11, comprising from about 1 percent, by weight, to about 80 percent, by weight, of said secondary fibers.

16. The elastic nonwoven web of claim 11 comprising from about 1 percent, by weight, by about 50 percent, by weight, of said secondary fibers.

17. The elastic nonwoven web of claim 11 comprising from about 5 percent, by weight, to about 25 percent, by weight, of said secondary fibers.

18. The elastic nonwoven web of claim 11 comprising from about 1 percent, by weight, to about 49 percent, by weight, of said secondary fibers and from about 1 percent, by weight, to about 49 percent, by weight, of a particulate material.

19. The elastic nonwoven web of claim 11, wherein said secondary fibers are selected from the group consisting of polyester fibers, polyamide fibers, glass fibers, polyolefin fibers, cellulosic derived fibers, multi-component fibers, natural fibers, absorbent fibers, electrically conductive fibers or blends of two or more of said secondary fibers.

20. The elastic nonwoven web of claim 19, wherein said natural fibers are selected from the group consisting of cotton fibers, wool fibers or silk fibers.

21. The elastic nonwoven web of claim 19, wherein said polyolefin fibers are selected from the group consisting of polyethylene fibers or polypropylene fibers.

22. The elastic nonwoven web of claim 19, wherein said cellulosic derived fibers are selected from the group consisting of rayon fibers or wood fibers.

23. The elastic nonwoven web of claim 19, wherein said polyamide fibers are nylon fibers.

24. The elastic nonwoven web of claim 19, wherein said multi component fibers are selected from the group consisting of sheath-core or side-by-side fibers.

25. An elastic nonwoven web consisting essentially of:

a coherent matrix of fibers formed from a polyetherester material having the general formula of:

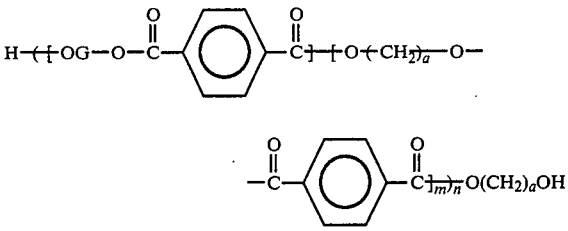

where:

G is selected from the group consisting of: poly(oxyethylene)-alpha,omega-diol poly(oxypropylene)-alpha,omega-diol poly(oxytetramethylene)-alpha,omega-diol and a, m and n are positive integers; and wherein said material has an elongation at break of from about 600 percent to 750 percent when measured in accordance with ASTM D-638 and a melt point of from about 350° F. to about 400° F. when measured in accordance with ASTM D-2117; and nonelastic secondary fibers.

26. An elastic nonwoven web comprising:

a coherent matrix of fibers formed from a polyetherester material having the general formula of:

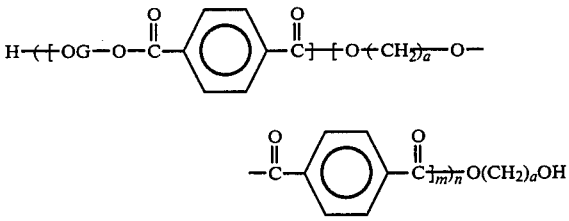

where:

"G" is selected from the group consisting of: poly(oxyethylene)-alpha,omega-diol poly(oxypropylene)-alpha,omega-diol poly(oxytetramethylene)-alpha,omega-diol and "a", "m" and "n" are positive integers; and wherein said material has an elongation at break of from about 600 percent to 750 percent when measured in accordance with ASTM D-638 and a melt point of from about 350° F. to about 400° F. when measured in accordance with ASTM D-2117; and particulate materials.

* * * * *